US005960571A

United States Patent [19]

Perry et al.

[11] Patent Number: 5,960,571

[45] Date of Patent: Oct. 5, 1999

[54] EARTH MOVER WITH AN ELEVATOR HAVING CHAIN TENSIONING MECHANISM

[75] Inventors: Gary D. Perry; Jeffrey Meyer, both of Lubbock, Tex.

[73] Assignee: Eagle-Picher Industries, Inc., Cincinnati, Ohio

[21] Appl. No.: 08/989,068

[22] Filed: Dec. 11, 1997

[51] Int. Cl.[6] ..... B65G 17/00; E02F 3/08

[52] U.S. Cl. ..... 37/411; 37/422; 37/419; 198/813

[58] Field of Search ..... 37/423, 422, 411, 37/416, 419; 198/813, 814, 520

[56] References Cited

U.S. PATENT DOCUMENTS

| | | | |
|---|---|---|---|
| 879,231 | 2/1908 | Wrabek | 37/338 |
| 2,667,709 | 2/1954 | Askue | 37/353 |
| 2,995,843 | 8/1961 | Hutchison | 37/362 |
| 3,028,693 | 4/1962 | Malzahn | 37/363 |
| 3,315,384 | 4/1967 | Weyers | 37/352 |
| 3,321,216 | 5/1967 | Carter . | |
| 3,930,323 | 1/1976 | Marold et al. . | |
| 3,946,619 | 3/1976 | Needles et al. . | |
| 4,128,952 | 12/1978 | Duke et al. . | |
| 4,223,462 | 9/1980 | Morris | 37/191 A |
| 4,279,604 | 7/1981 | Kooi et al. | 414/667 |
| 4,422,667 | 12/1983 | Perry | 280/705 |
| 4,498,837 | 2/1985 | Kooi et al. | 414/664 |
| 4,974,348 | 12/1990 | Wallace | 37/87 |
| 4,999,902 | 3/1991 | Schmacher et al. | 29/464 |
| 5,245,769 | 9/1993 | Wammock | 37/357 |

FOREIGN PATENT DOCUMENTS

| | | | |
|---|---|---|---|
| 646190 | 11/1950 | United Kingdom | 198/813 |

*Primary Examiner*—H. Shackelford
*Attorney, Agent, or Firm*—Wood, Herron & Evans, LLP

[57] ABSTRACT

An earth mover scraper combination having chain driven elevator drive sprockets for each of two chains which are mounted on plates that include pins extending into the frame of the elevator support. Two jacks are likewise inserted into the frame of the elevator support and can be used to force the pins away from the frame support thereby forcing the sprocket away from the frame support and tensioning the chain. Preferably, the jack is a hydraulic jack that can be operated with a simple grease gun. Metal shims are then placed between the mounting bracket and the frame assembly to maintain the chain tension.

7 Claims, 4 Drawing Sheets

EARTH MOVER WITH AN ELEVATOR HAVING CHAIN TENSIONING MECHANISM

BACKGROUND OF THE INVENTION

Earth movers are employed to move relatively large volumes of earth. There are different types of these devices. There is a "push-pull" type device which has power driven front and rear wheels that move a blade across the ground and force dirt and soil into the bowl of the earth mover. Another type of earth mover is a scraper/elevator. This device is typically pulled from the front and has a scraper blade that contacts and lifts dirt. The dirt is then pushed to the rear of the bowl of the earth mover by the elevator which is a series of horizontal blades which are supported on either side by a driven chain. These rotating blades simply push the earth to the back of the bowl. When it is desirable to unload the earth mover, the floor of the bowl can be opened partially and a pusher forces the dirt forwardly. The blades in turn are reversed, if desired, and force the dirt out of the earth mover bowl.

Over a period of time the chains stretch and therefore the tension must be adjusted. In the past, the chains would ride on idler sprockets which were attached to a scissor-type linkage which could force the idler sprocket outwardly in turn adjusting the tension. This was a very difficult task usually requiring two people.

SUMMARY OF THE INVENTION

Accordingly, it is the object of the present invention to provide an earth mover with an elevator assembly wherein the chains can be easily adjusted. Further, it is the object of the present invention to provide such a mechanism which can be operated by a single individual.

The present invention is premised on the realization that the chain of an elevator assembly for an earth mover can be adjusted by a jack located in the elevator frame. The drive sprockets are mounted on a mounting assembly which includes a post extending into the frame of the elevator above a jack. By extending the jack, the post is forced outwardly from the frame thereby forcing the drive sprocket away from the frame and tensioning the chain. In order to maintain the tension, a metal shim is placed in between the mounting assembly and the frame of the elevator assembly. The mounting assembly is then bolted to the frame and the pressure on the hydraulic jack released without altering the tension on the chain.

This is an extremely inexpensive apparatus to adjust the chain tension and further this can be accomplished by a single individual. The objects and advantages of the present invention will be further appreciated in light of the detailed description and drawings in which the:

DETAILED DESCRIPTION

Figure 1:
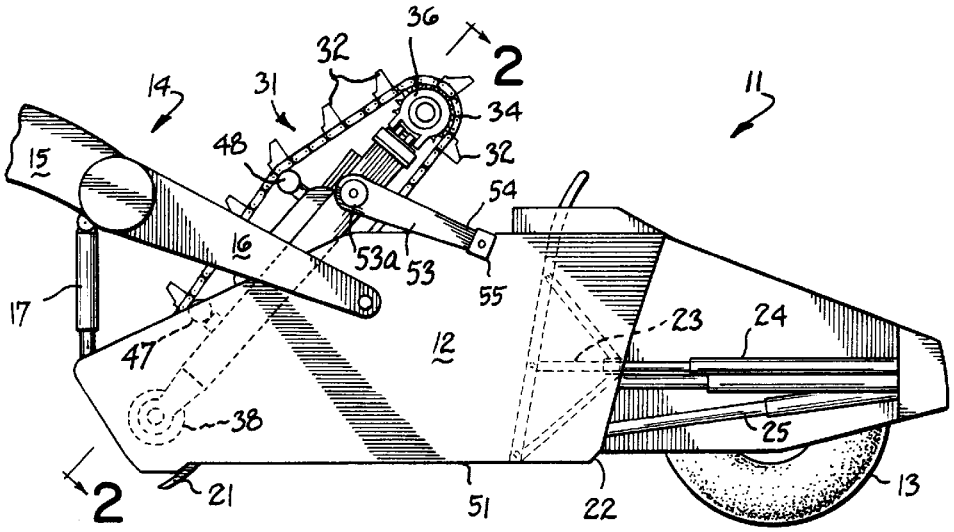
FIG. 1 is a diagrammatic side-view of an earth mover with an elevator assembly.

As shown in FIG. 1, there is an earth mover 11 which includes a bowl 12 which is supported at a rear end by tires 13 and by the front end by a draft frame 14. The draft frame 14 includes a gooseneck 15 shown partially broken away which attaches to right and left draft arms 16. Bowl 12 can be raised and lowered by a pair of hydraulic cylinders 17 acting on arms 16. This acts to adjust the front end of bowl 12. The gooseneck 15, of course, is attached to a tractor (not shown).

At the bottom of bowl 12, is a scraper blade 21 which scrapes up layers of dirt to be introduced into the interior of the bowl. The rear 22 of bowl 12 includes an ejector 23 (shown in phantom) which is moved either forwardly or rearwardly by an ejector cylinder 24. Also shown, is a floor cylinder 25 which opens or closes the floor (not shown) of the bowl 12 to allow dirt to either enter or be discharged from the bowl.

Figure 2:
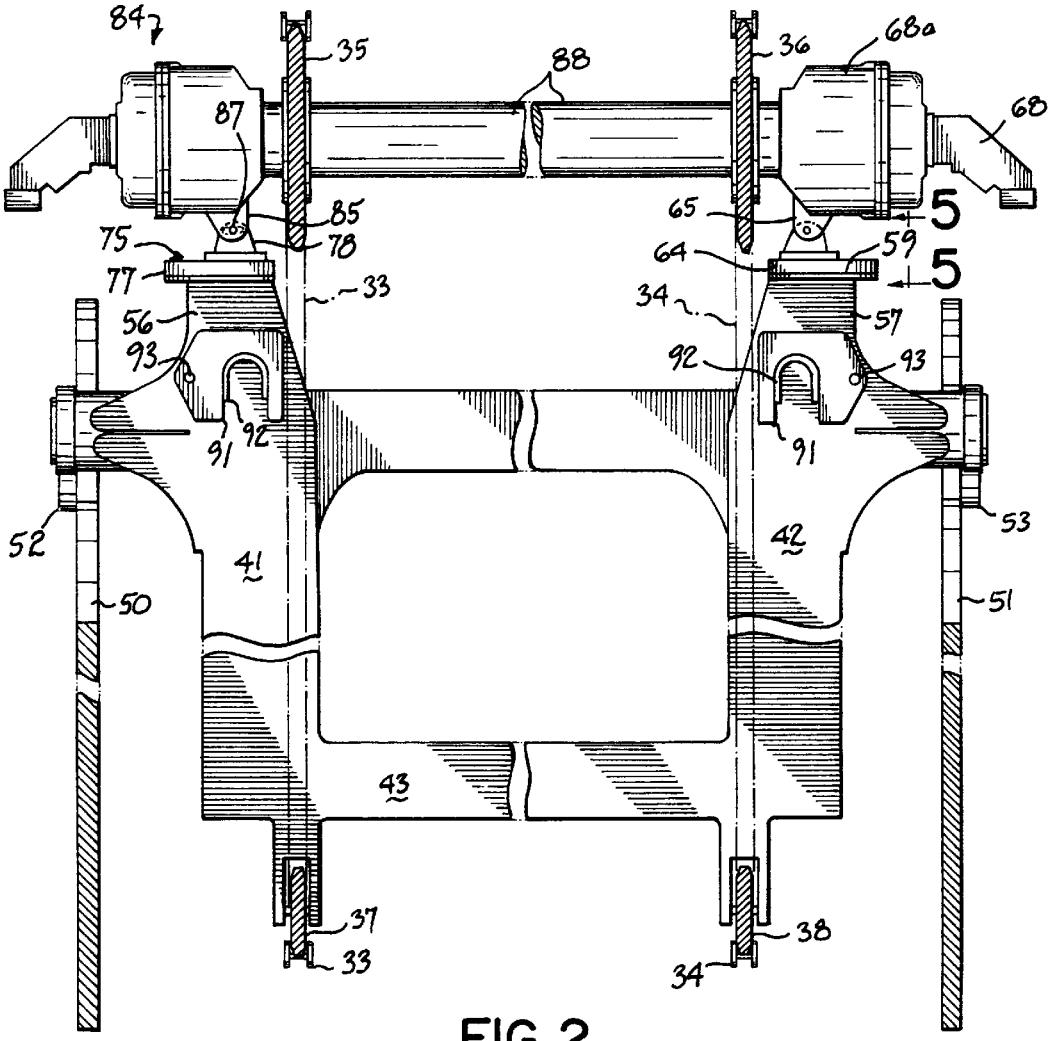
FIG. 2 is a view partially in cross section and taken generally along lines 2—2 of FIG. 1.

The earth mover 11 further includes an elevator assembly 31 having a plurality of horizontal scraper blades 32 which ride on first and second chains 33 and 34 (See FIG. 2). Based on the perspective of one facing the earth mover 11 these are also referred to as left chain 33 and right chain 34. These chains run parallel to each other and are supported at their upper ends by upper drive sprockets 35 and 36 and at their lower ends by idler sprockets 37 and 38. It should be understood that rollers can be used in place of sprockets as is well known to those skilled in the art. Accordingly, the term sprocket is intended to include the term roller. The four sprockets themselves are supported by generally vertical side frame members 41 and 42. The side frame members 41 and 42 are separated from each other at their lower ends by lower horizontal frame member 43 and at their upper ends by an upper tubular horizontal frame member 44. Two idler rollers 47 and 48 (FIG. 1) are supported on each side frame members 41 and 42.

The tubular upper horizontal frame member 44 extends beyond the side walls 50 and 51 of bowl 12 and is welded to elevator left and right arms 52, 53. Both arms are the same and only one arm 53 is shown (see FIG. 1). Elevator arm 53 includes a first end 53*a* which is welded to the end of tubular horizontal frame member 44 and a second end 54 which is pivotally attached to side wall 51 at trunion 55.

The upper portions 56 and 57 of the frame members 41 and 42 include a top planar surfaces 58,59 and central axial bores 60, 61 which extend through the respective top 56 and 57 into a left and right interior portions 56*a* & 57*a* of the tubular member 44.

The right drive sprocket 36 is supported by a right side mounting assembly 62. Mounting assembly 62 includes a post 63 which extends into bore 61 and a plate 64, which is welded to post 63 and rests on the top planar surface 59. Plate 64 includes: Two spaced lugs 65 having aligned central holes 66. The plate 64 is bolted to top surface of upper portion 56 with bolt 67.

The left drive sprocket 35 is supported by a mounting assembly 75 which includes a post portion 76 welded to a plate 77. As with plate 64, two lugs 78 are in turn welded to plate 77. Lugs 78 include aligned elongated holes 86. The post 76 extends into the central axial bore 60 which extends through the top surface 58 of side frame portion 41 into the interior 56*a* of the tubular frame member 44. The plate 77 in turn is bolted to the top surface 58 with bolt 83.

Figure 5:
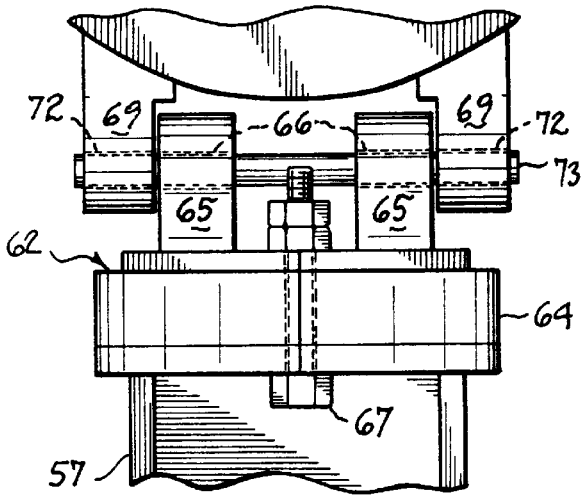
FIG. 5 is a view taken on line 5—5 of FIG. 2.

As best seen in FIG. 5, the right side drive motor 68 drives sprocket 36 via reducer 68*a*. The reducer includes two lugs 69 which have central aligned bores 72. Lugs 69 in turn are mounted to lugs 65 with pin 73 which extends through holes 66 and 72.

A similar drive and mounting also is used for the left side where it can be seen that, the sprocket 35 is driven by a motor and reducer assembly 84 which has two identical spaced lugs 85 extending from the bottom thereof. These lugs each include aligned holes and are attached to the lugs 78 of the mounting assembly 67 with pin 87. The two separate drives are interconnected via the horizontal tube 88 and are driven at the speed by equal pressure to each hydraulic motor.

Figure 3:
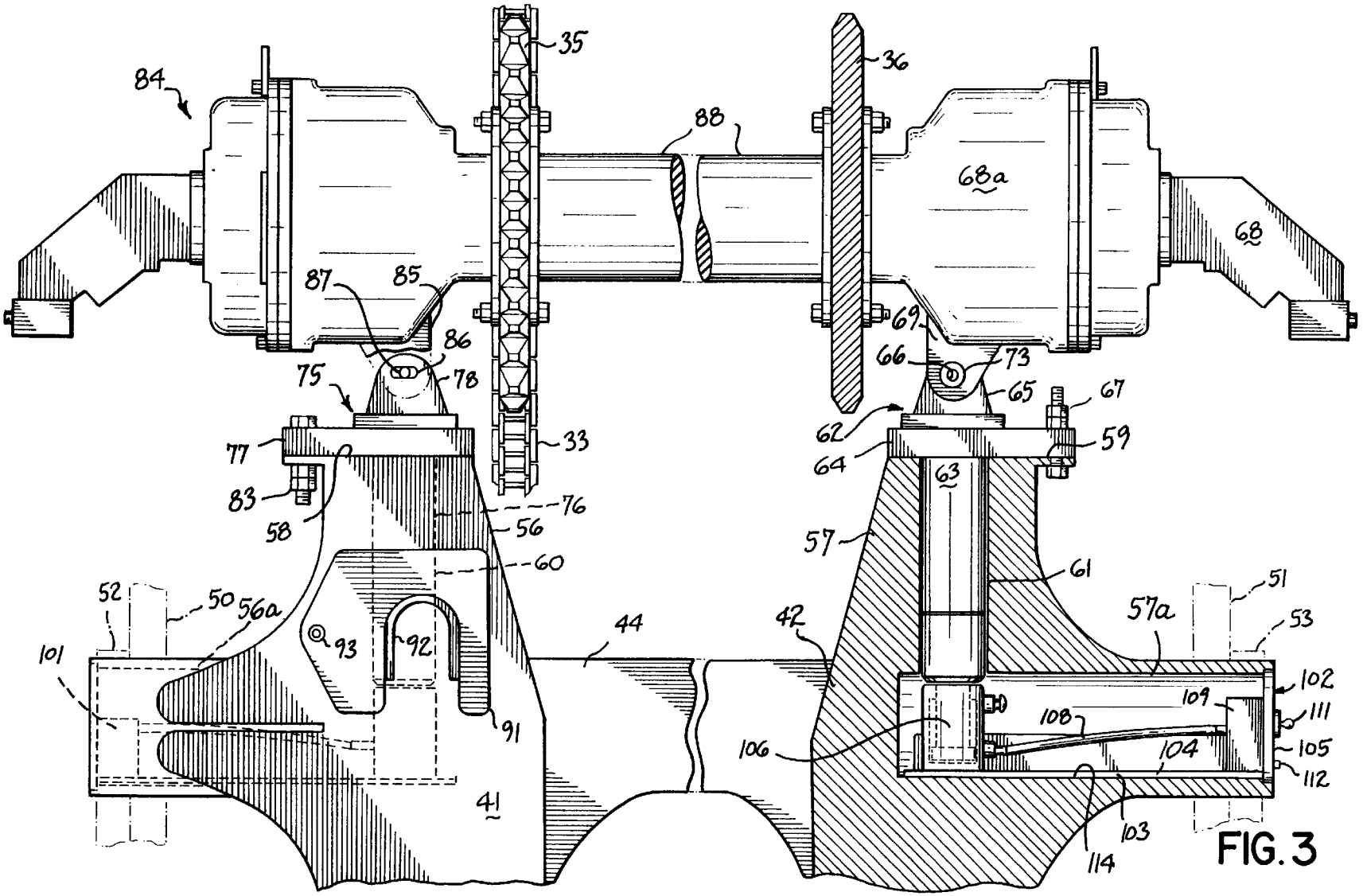
FIG. 3 is an enlarged view, partially broken away, of the upper area of FIG. 2.

As shown in FIG. 3, there are a plurality of shims 91 which have a U-shaped open portion 92 bolted to the top of the side frame member 41 by bolt 93, resting also on a U-shaped bracket 95. Although not shown, shims 91 are also stored in a similar manner on frame member 42. These shims are simply stored at these locations and are used to adjust the chain tension as needed.

Figure 6:
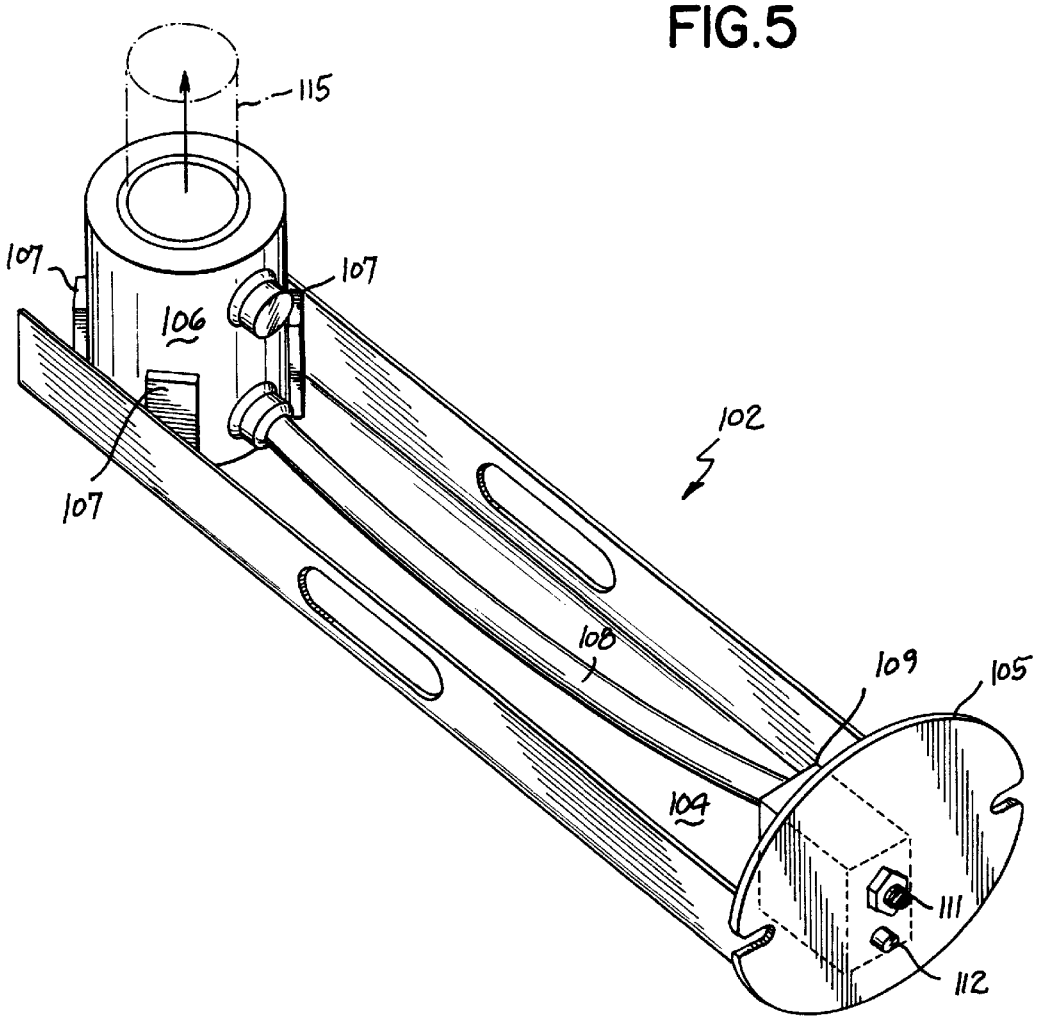
FIG. 6 is an isometric view of a jack assembly used to practice the invention.

Inside either hollow portion 56*a*, 57*a* of tubular member 44 are left and right jack assemblies 101 and 102. Each jack assembly is identical and only right jack assembly 102 is described herein. As shown in FIG. 6, the jack assembly includes a tray 103 which has a bottom wall 104. At the outer end one end thereof is an end closure plate 105 which is adapted to be bolted to the tubular wall of frame member 44. At the opposite end of the tray 103 is a hydraulic jack 106 which is held in position by four tabs 107 extending up from the bottom wall 104 of tray 103. Extending from the jack 106 is the hydraulic line 108 which acts to operate the jack. The hydraulic line extends to a block 109 which connects the hydraulic line to grease fitting 111 and pressure release valve 112. Two bolts (not shown) pass through plates 105 and bolt the jack assembly to the member 44.

Figure 4A:
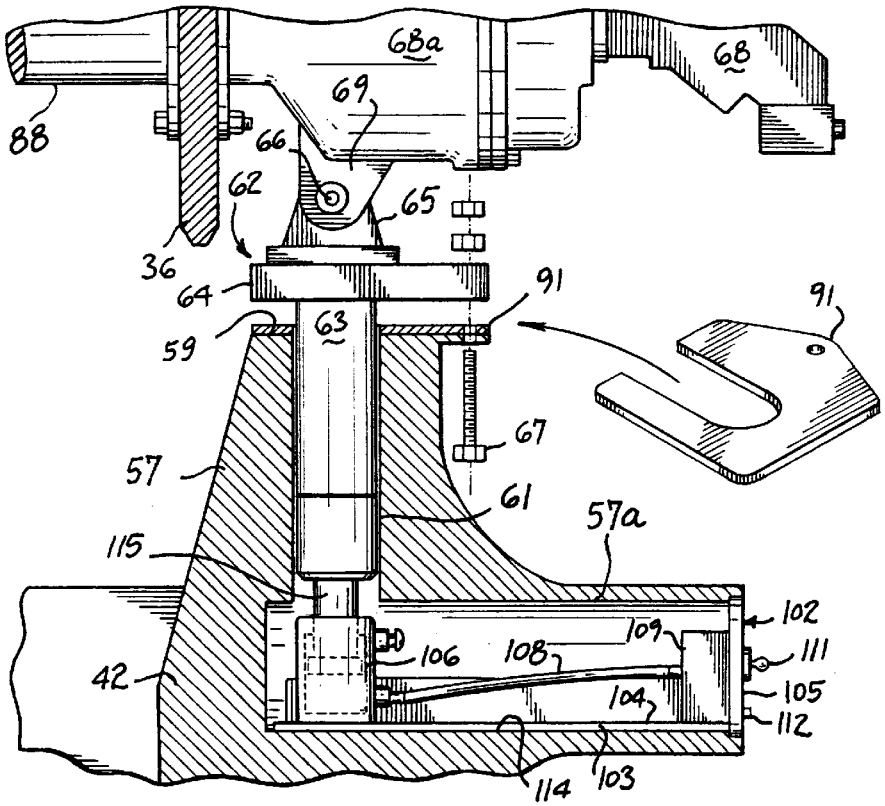
FIG. 4A & 4B are cross sectional views of the right portion of FIG. 2 showing the method of practicing the present invention.
Figure 4B:
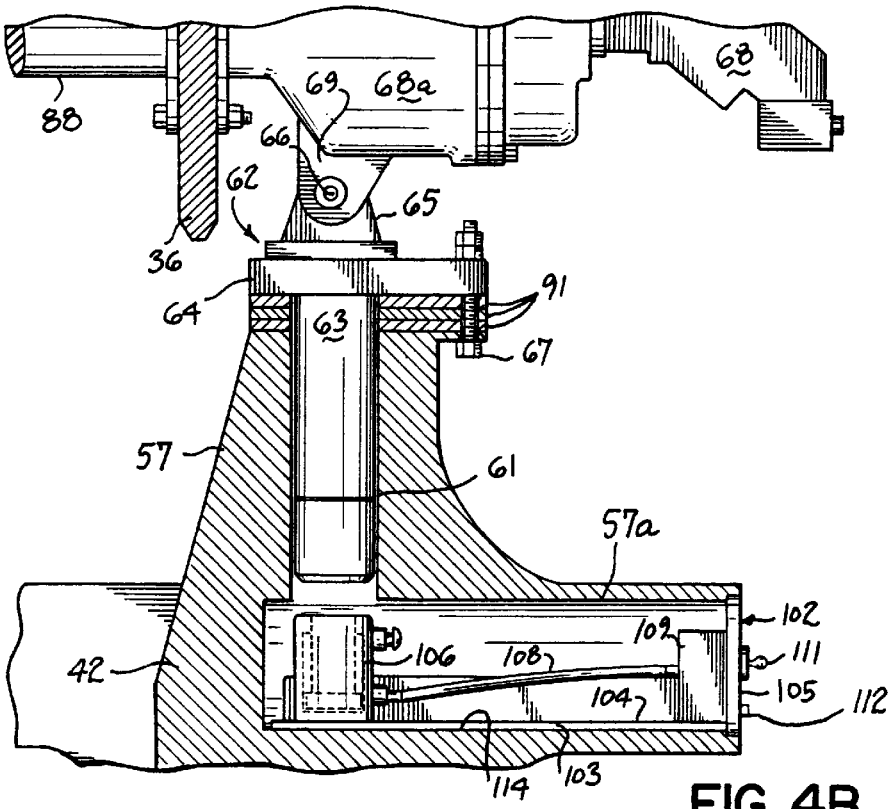

When in position, the bottom wall 104 rests upon a planar surface 114 within horizontal tubular member 44. As shown in FIG. 4A, when the jack 106 is activated by forcing hydraulic fluid or grease through hydraulic line 108, it acts to force the post 115 up towards post 76 or 63 which will cause the mounting assembly and thus the drive motor to move away from tubular member 44 as discussed below.

In order to adjust the tension of the chains, the bolts 67 and 83 on either side of the elevator assembly are removed. The operator will then elevate the post 115 of the jack 106 using either hydraulic fluid or simply a grease gun. Post 115 extends upwardly and engages the post 63 which in turn forces the drive motor and the sprocket on one side of the earth mover upwardly, increasing the tension on chain 36. Because the opposite side mounting assembly 75 includes elongated holes 86, this side can move slightly toward the opposite side to permit the movement of drive assembly 68, 68*a*. One or more shims 91 is inserted between plate 62 and surface 59 to maintain the tension on chain 36.(See FIG. 3A). The pressure on jack 106 can then be released. This is then repeated on the opposite side.

This maintains the tension on the chain using the frame as opposed to the internal jacks. Once the bolts are tightened the earth mover is then ready for operation.

It is also possible to employ only a single jack assembly 102 since the jack assembly rests on a tray which slides into the interior of tube 44. These can be easily unbolted and moved from one side to the other. Thus, a jack can be used on one side and shims put into position, the pressure released. The jack can then be removed and taken to the opposite side to tension the second chain. Although a hydraulic jack is preferred, other types of jack mechanisms can be employed such as a worm gear jack.

Thus, according to the present invention, the chains on an earth mover can be easily tensioned using only one individual. Further this operation can be done quickly. Further, the use of jacks in combination with metal shims prevents the chain from loosening quickly.

This has been a description of the present invention along with the preferred method of practicing the present invention currently known to the inventors. However, the invention itself, should be defined by the appended claims wherein we claim:

1. An earth mover scraper combination comprising a bowl having first and second side walls, an elevator assembly supported by said bowl;

said elevator assembly having first and second side frame members;

said side frame members each having upper and lower sprockets at distal ends thereof;

an upper horizontal frame member extending between said side frame members;

first and second chains each running on said upper and lower sprockets of said side frame member;

a plurality of horizontal blades fixed to said chains wherein said upper sprockets each include a support member extending into bores in upper ends of said side frame members;

a jack located within one side of said upper horizontal frame member and adapted to move one of said support members relative to said upper end and thereby increase tension on said chain;

wherein each said support member includes a plate and a post extending into said bore and wherein said jack is positioned to engage and move said post thereby spacing said plate from said horizontal support; and a plurality of shims adapted to be placed between said plate and said horizontal support.

2. The apparatus claimed in claim 1 wherein said plate includes two aligned plate lugs and further wherein said sprocket is attached to two aligned sprocket lugs wherein said plate lugs and said sprocket lugs are held together by a pin.

3. The apparatus claimed in claim 1 wherein said jack is a hydraulic jack.

4. An apparatus claimed in claim 1 having two jacks, one positioned in left and right ends of said horizontal frame member, one each aligned with said plates.

5. An earth mover scraper combination comprising a bowl having first and second side walls, an elevator assembly supported by said bowl:

said elevator assembly having first and second side frame members;

said side frame members each having upper and lower sprockets at distal ends thereof;

an upper horizontal frame member extending between said side frame members;

first and second chains each running on said upper and lower sprockets of said side frame member;

a plurality of horizontal blades fixed to said chains wherein said upper sprockets each include a support member extending into bores in upper ends of said side frame members;

a jack located within one side of said upper horizontal frame member and adapted to move one of said support members relative to said upper end and thereby increase tension on said chain;

wherein one of said support members each includes lugs at least one of said lugs having an elliptical hole.

6. The apparatus claimed in claim 2 wherein one of said sprocket lugs includes elliptical holes.

7. An earth mover scraper combination comprising:

a bowl having first and second side walls;

an elevator assembly supported by said bowl;

said elevator assembly having first and second side frame members each of said side frame members having upper and lower sprockets and upper and lower horizontal frame members extending between said side frame members wherein said upper horizontal frame members extend beyond said side walls of said bowl and are mounted to said earth mover by elevator support arms rotatably mounted on the exterior portions of said side walls;

first and second chains one each running on said upper and lower sprockets of said side frame members;

a plurality of horizontal blades fixed at distal ends thereof to said chains;

wherein said upper sprockets each include a support member; said support member comprising a plate and a post;

said posts extending into bores in upper ends of said side frame members;

first and second jack located one each within side portions of said upper horizontal frame member and aligned with said bores in said horizontal frame member and adapted to move said posts outwardly from said horizontal frame member;

and at least one metal shim adapted to be positioned between one of said plates and said horizontal frame members whereby said chain is tensioned by activating one of said jacks causing one of said mounting plates to separate from said horizontal frame member and wherein said tension is maintained by at least one shim positioned between said plate and said frame member.

* * * * *